US007410546B2

(12) United States Patent
Tews

(10) Patent No.: US 7,410,546 B2
(45) Date of Patent: Aug. 12, 2008

(54) PLATINUM ALLOY AND METHOD OF PRODUCTION THEREOF

(75) Inventor: Peter Tews, Birkenfeld (DE)

(73) Assignee: Karat Platinum, LLC, Inwood, NY (US)

( * ) Notice: Subject to any disclaimer, the term of this patent is extended or adjusted under 35 U.S.C. 154(b) by 0 days.

(21) Appl. No.: 10/771,883

(22) Filed: Feb. 4, 2004

(65) Prior Publication Data

US 2005/0169791 A1 Aug. 4, 2005

(51) Int. Cl.
*C22C 5/00* (2006.01)

(52) U.S. Cl. ..... 148/430; 420/486

(58) Field of Classification Search ..... 148/430; 420/466

See application file for complete search history.

(56) References Cited

U.S. PATENT DOCUMENTS

| | | | | |
|---|---|---|---|---|
| 382,827 | A * | 5/1888 | Ostermann et al. | 420/468 |
| 2,279,763 | A | 4/1942 | Sivil | |
| 6,048,492 | A | 4/2000 | Shersher | |
| 6,869,567 | B2 * | 3/2005 | Kretchmer | 420/466 |

FOREIGN PATENT DOCUMENTS

| | | | |
|---|---|---|---|
| EP | 1 308 527 | | 5/2003 |
| JP | 356029641 | * | 3/1981 |
| JP | 359143032 | * | 8/1984 |
| JP | 61-106736 | | 5/1986 |
| JP | 61106736 | | 5/1986 |
| JP | 61133340 | | 6/1986 |
| JP | 62-130238 | | 11/1987 |
| JP | 404087260 | * | 3/1992 |
| JP | 2000-287999 | * | 10/2000 |

OTHER PUBLICATIONS

English language translation of JP 2000-287999, Oct. 2000.*
Patent Abstracts of Japan, Platinum Alloy for Accessory, Publication No. 61034133, Publication Date: Feb. 18, 1986.
WO 2004/059019, Pt-Base Bulk Solidifying Amorphous Alloys, Publication Date: Jul. 15, 2004.
B.A. Rogers, "The Nature of Metals", American Society for Metals and Iowa State University Press, 1964, pp. V-X, 111-128, 315, and 320, Dec. 1964.
H.W. Pollock, "Materials Science and Metallurgy", Reston Pub. Inc., 1981, pp. 266-299, Dec. 1981.
"The Metals Handbook", Am. Soc'y Metals, 1986, vol. 10, pp. 1 and 2, vol. 11, pp. 1 and 2, Dec. 1986.
Chinese Office Action with translation, issued by the State Intellectual Property Office on Feb. 1, 2008, in connection with Chinese App. No. 200480041383.1 (18 pages).
Li Da-de, "Brief Introduction of Technologies of Producing Platinum Jewelry, Part I," with translation, Jewelry Science, 1998 (2), pp. 54-58 (14 pages).

* cited by examiner

*Primary Examiner*—Scott Kastler
(74) *Attorney, Agent, or Firm*—McCarter & English, LLP

(57) ABSTRACT

The disclosure relates to a platinum alloy comprising (a) 55 to 63 wt. % of platinum, (b) 2 to 10 wt. % of cobalt, and (c) 27 to 43 wt. % of copper. The disclosure further relates to a platinum alloy comprising (a) 70 to 79.5 wt. % of platinum, 2 to 10. wt. % of cobalt, and (c) 10.5 to 28 wt. % of copper. The platinum alloys have excellent mechanical and optical properties for use in the production of ornamental articles such as rings, necklaces, earrings, watch bands, watch bodies and other jewelry. The disclosure further relates to a method of preparing the platinum alloys and their use in the production of ornamental articles. Still further the disclosure relates to ornamental articles comprising the platinum alloy and a method of production thereof.

34 Claims, No Drawings

PLATINUM ALLOY AND METHOD OF PRODUCTION THEREOF

FIELD OF THE INVENTION

The present invention relates to a platinum alloy and a method of production thereof. In particular, the present invention relates to platinum alloys that are suitable for the fabrication of ornamental articles such as rings, necklaces, bracelets, earrings, watch bands, watch bodies and other jewelry. Furthermore, the present invention relates to an ornamental article made from the platinum alloy and a method of production thereof.

BACKGROUND OF THE INVENTION

Platinum is a precious metal and is relatively expensive. In recent years platinum has come into increasing prominence as a metal used for jewelry fabrication. Platinum for fine jewelry is commonly sold in high concentrations of over 85 percent by weight.

Pure platinum metal (Pt1000) is soft and does not have the mechanical strength for most jewelry applications. For this reason, in most jewelry applications various kinds of platinum alloys are employed. Platinum alloys are desirable for their neutral color when combined with gems, they are hypoallergenic, they have high tensile strength, and a pleasurable heft due to their high-density.

The jewelry industry uses three main classes of platinum alloys. These classes are Pt950, Pt900 and Pt850. These alloys have a platinum content of 95, 90 and 85 wt. %, respectively. Commercially available alloys frequently used in the fabrication of jewelry include Pt/Ir 900/100 (90 wt. % platinum and 10 wt. % iridium), PtCu950 (95 wt. % of platinum and 5 wt. % of copper) and PtCo950 (95 wt. % of platinum and 5 wt. % of cobalt).

Various high platinum content jewelry materials are known in the art. The term "high platinum content" as used herein refers to platinum alloys having a platinum content equal or greater than 85 wt. %.

For example, U.S. Pat. No. 4,165,983 describes an alloy for fabricating jewelry containing at least 95 wt. % platinum, 1.5 to 3.5 wt. % gallium, and a balance of at least one of indium, gold, palladium, silver, copper, cobalt, nickel, ruthenium, iridium and rhodium. U.S. Pat. No. 5,846,352 describes a heat-treated platinum-gallium alloy for fabricating jewelry containing 1 to 9 wt. % gallium and a small amount of palladium. Japanese published patent application JP 61-133340 describes an alloy for fabricating jewelry consisting of 84 to 96 wt. % platinum, 1 to 10 wt. % gallium, 0.5 to 10 wt. % copper, and 0.01 to 5 wt. % cobalt. Japanese published patent application JP 61-034133 describes an alloy for fabricating jewelry containing 84 to 96 wt. % platinum, 0.5 to 10 wt. % cobalt, 0.5 to 10 wt. % copper and 0.01 to 0.5 Y, B, CaB mischmetal.

Although such alloys have satisfactory mechanical and optical properties that make them suitable for jewelry fabrication, these alloys are expensive to produce due to their high platinum content.

There are also a number of low platinum content jewelry materials known in the art. The term "low platinum content" as used herein refers to platinum alloys having a platinum content smaller than 85 wt. %.

U.S. Pat. No. 6,048,492 describes a platinum alloy composition for use in jewelry products containing about 58.5 wt. % of platinum, 26.5 to 36.5 wt. % of palladium and 5 to 15 wt. % of either iridium, copper or ruthenium. U.S. Pat. No. 2,279, 763 describes a ductile platinum alloy containing 10 to 80 wt. % of platinum, 12 to 90 wt. % of palladium, and 1 to 15 wt. % of ruthenium.

A disadvantage of known low platinum content jewelry materials is that they often have inferior mechanical and physical properties compared to the high platinum content jewelry materials. In particular, the castability of known low platinum content jewelry materials is not as good as that of high platinum content alloys. Also, the color of known low platinum content jewelry materials differs from the typical "platinum color" of Pt950 alloys that is desired by most customers of fine jewelry. Hence, low platinum content jewelry materials are often rejected by customers for aesthetical reasons. In fact, it is very difficult to produce a low platinum content jewelry material that combines both the mechanical strength and workability as well as the optical properties of high platinum content materials.

Due to the potential improvements in properties and performance of such alloys, there is a need for additional alloys suitable for use in jewelry and art applications.

Another disadvantage of known low platinum content jewelry materials is that they generally comprise alloys of platinum and at least one other precious material such as palladium and/or ruthenium, which are themselves relatively expensive materials, so that jewelry made from known low platinum content materials is still relatively costly.

Accordingly, it would be desirable to provide a platinum alloy composition suitable for jewelry that is less expensive than the platinum that is presently available, yet still provides a platinum jewelry item with desirable technological and optical properties.

It would also be desirable to provide low platinum content alloys consisting essentially of platinum and non-precious metals in which the platinum content comprises 58.5 wt. % or 75 wt. % to correspond with 14 karat or 18 karat on a 24 karat scale in order to facilitate an understanding in the minds of consumers (who are familiar with the karat scale from its use in connection with gold alloys) of the weight percentage of platinum contained in the alloys.

SUMMARY OF THE INVENTION

According to the present invention there is provided an improved low platinum content alloy composition that contains 55 to 63 wt. % of platinum, 2 to 10 wt. % of cobalt and 27 to 43 wt. % of copper. Furthermore, according to the present invention an alloy is provided that contains 70 to 79.5 wt. % of platinum, 2 to 10 wt. % of cobalt, and 10.5 to 28 wt. % of copper.

The alloys according to the present invention are particularly well suited for the fabrication of ornamental articles, such as rings, necklaces, earrings, watch bands, watch bodies and other jewelry.

Surprisingly, it was found that despite of their relatively low platinum content the alloys of the present invention exhibit excellent mechanical and optical properties that make them extremely suitable for the manufacturing of ornamental products such as jewelry of any kind. Due to the lower density of the alloys of the present invention it is possible to manufacture thinner, lighter constructions and castings at considerable less cost than with high platinum content alloys (e.g. Pt850, Pt900, Pt950).

The platinum alloys of the present invention have a lower melting range compared to known low platinum content alloys as described in, for example, U.S. Pat. No. 6,048,492. Due to their relatively low melting temperature they cast easier than previously known platinum alloys and are more energy efficient. This lower temperature alloy also allows a lower mold temperature, decreasing defect rate due to shrinkage porosity, investment cracking, inclusions, and contaminations that occur more readily at highly-elevated temperatures.

The alloys according to the present invention are particularly well suited for the fabrication of jewelry due to their improved hardness, workability, castability, deformability, wear and abrasion properties, and resistance to corrosion. The platinum alloy composition of the invention appears and looks no different than 95 percent platinum, but is substantially lighter, less dense, and thus, less expensive to produce. In fact, the platinum alloy composition of the present invention has essentially the same color and appearance as PtCu950 alloy.

The invention further relates to a method of preparing the alloys of the present invention by formulating and mixing the components of the alloy in the specified amounts and melting them together.

The alloy may be formed into a desired shape. Such operations are many and include casting or fabricating. Some examples of fabrication can be by rolling of the alloy into a sheet, drawing a wire, molding, casting, forging, stamping or constructing the object or shape useful as a jewelry component.

Accordingly, the invention also relates to a method of manufacturing an ornamental article, which comprises formulating one of the platinum alloys described above and then utilizing the alloy as a component of jewelry.

Further, the invention also relates to the use of such alloys in the production of ornamental articles such as jewelry. Still further, the invention relates to ornamental articles comprising such alloys.

Accordingly, it is an object of the invention to provide an improved low platinum content platinum alloy composition.

Still another object of the invention is to provide an improved platinum alloy composition that is suitable for use in jewelry for the mass commercial market.

A further object of the invention is to provide an improved platinum alloy composition which is substantially lighter and less dense than conventional platinum alloy compositions.

Still further it is an object of the invention to provide platinum alloys which may be cast more readily than known platinum alloys.

Yet another object of the invention is to provide an improved low platinum content alloy that does not contain any significant amount of precious materials other than platinum.

Still yet another object of the invention is to provide an improved low platinum content alloy that does not contain any significant amount of precious metals other than platinum, and wherein the weight percent of platinum is equivalent to 14 and 18 karat on a 24 karat scale. Still other objects and advantages of the invention will in part be obvious, and will in part be apparent from the following description.

DETAILED DESCRIPTION

The platinum alloy compositions of the invention include platinum in an amount of 55 to 63 wt. % or 70 to 79.5 wt. %. The platinum content of the alloy compositions of the invention is significantly lower than, that of conventional Pt850, Pt900 and Pt950 platinum alloys commonly used in the jewelry industry.

According to one embodiment of the invention the platinum alloy comprises:

55 to 63 wt. % of platinum;

2 to 10 wt. % of cobalt; and 27 to 43 wt. % of copper.

Preferably, the platinum content of this alloy is from 57.5 to 59.9 wt. %, in particular from 58.5 to 59.0 wt. %, based on the total alloy composition. If the platinum content of the alloy is smaller than 55 wt. % the workability and stampability of the alloy decrease significantly and the alloy loses its platinum-like color. If the platinum content of the alloy is greater than 63 wt. %, the costs for the production of the alloy increase significantly while, at the same time, the mechanical and chemical properties of the alloy do not improve significantly.

Preferably, the cobalt content of the alloys of the present invention is from 2.0 to 8.0 wt. %, in particular 3.5 to 5.5 wt. %, based on the total alloy composition. If the cobalt content of the alloy is smaller than 2 wt. %, the mechanical properties and the workability of the alloy decrease significantly and the alloy loses its platinum-like color. If the cobalt content of the alloy is greater than 10 wt. % the alloy becomes too hard.

Preferably, any balance in the alloys of the present invention is made up by copper.

The platinum alloys of the present invention may further comprise 0.001 to 2 wt. % of at least one first metal selected from the group consisting of palladium, iridium and ruthenium. A combination of these elements may also be added, so long as the total amount does not exceed 2 wt. % of the alloy composition. An addition of palladium is useful in order to vary the color of the alloy. Iridium and/or ruthenium can be added as metal hardeners in order to improve the hardness of the alloy, with iridium being the preferred hardener since it offers gradual hardness improvements over a wide range of concentrations, with no deterioration of alloy properties.

The platinum alloys of the present invention may further comprise 0.001 to 2 wt. % of at least one second metal selected from the group consisting of indium and gallium. A combination of these elements may also be added, so long as the total amount does not exceed 2 wt. % of the alloy composition. Indium and gallium may be added to improve the precipitation hardening of the alloy.

Advantageously, the alloy can include any one of a number of property enhancing agents, including a deoxidizing agent, grain reducing agent, a viscosity decreasing agent or a color variation agent. The number and amount of the other additives may vary depending on the desired mechanical properties of the alloy and can readily be determined by a person of ordinary skill in the art by means of routine experiments.

According to another embodiment of the invention, the platinum alloy consists essentially of, apart from impurities, 57.5 to 59.9 wt. % of platinum, 3.5 to 4.5 wt. % of cobalt, and 35.6 to 39 wt. % of copper, wherein 0.001 to 2 wt. % of copper may be substituted by at least one of the first metals and 0.001 to 2 wt. % of copper may be substituted by at least one of the second metals.

The alloys of the present invention exhibit excellent mechanical and physical properties such as tensile strength, Vickers hardness and elongation at break. The tensile strength of the platinum alloys of the present invention is in the range of 450 to 800 $N/mm^2$. The Vickers hardness of the platinum alloys of the present invention, measured at softened state, is in the range of 130 to 210 HV10. The elongation at break of the platinum alloys of the present invention is at least about 20%.

A further advantage of the present invention is that the color tone of the platinum alloy corresponds essentially to the platinum white color tone of a PtCu950 alloy, which is aesthetically very appealing.

According to another embodiment of the invention the platinum alloy comprises:

70 to 79.5 wt. % of platinum, 2 to 10 wt. % of cobalt, and 10.5 to 28 wt. % of copper.

Preferably, this platinum alloy comprises 72 to 78 wt. %, particularly 74 to 76 wt. % of platinum. If the platinum content of the alloy is smaller than 70 wt. % the workability of the alloy decreases. If the platinum content of the alloy is greater than 79.5 wt. %, the costs for the production of the alloy increase significantly while, at the same time, the mechanical and chemical properties of the alloy do not improve accordingly.

The alloy of the invention having a platinum content of 70 to 79.5 wt. % may contain further components as specified above for the alloy of the invention having a platinum content of 55 to 63 wt. %. Also, the physical and chemical properties such as tensile strength, Vickers hardness, elongation a t break and color are the same as specified above for the alloy of the invention having a platinum content of 55 to 63 wt. %.

According to yet another embodiment of the invention the alloys consist essentially of platinum metal in an amount of 55 to 63 wt. % or 70 to 79.5 wt. % and one or more non-precious metal.

The term "non-precious metal" as used herein refers to any metal that does not belong to the group of precious metals (gold, silver, mercury, rhenium, ruthenium, rhodium, palladium, osmium, iridium and platinum). Non-precious metals that can be included in the alloy of the present invention are, for example, copper, iron, cobalt, nickel, indium, and/or gallium.

The term "consisting essentially of" as used herein is meant to describe all components of the alloy with the exception of impurities and property enhancing additives such as hardeners (e.g. iridium and/or ruthenium) a deoxidizing agent, grain reducing agent, a viscosity decreasing agent or a color variation agent (e.g. palladium), wherein the total amount of property enhancing additives is less than 5 wt. %, preferably less than 3 wt %, more preferably less than 2 wt. %, even more preferably less than 1 wt. %, and most preferably less than 0.5 wt. %.

According to a further preferred embodiment the alloy of the present invention consists essentially of 55 to 63 wt. % platinum, 2 to 10 wt. % of cobalt, and 27 to 43 wt. % of copper. According to yet a further preferred embodiment the alloy of the present invention consists essentially of 70 to 79.5 wt. % of platinum, 2 to 10 wt. % of cobalt and 10.5 to 28 wt. % of copper.

The alloys of the present invention may be prepared by conventional alloying methods that are well known in the art. The preparation of the alloy generally includes the step of melting platinum, cobalt and copper and any other component in the specified amounts. The method may further include the step of hardening the alloy by cold working or heat treatment.

The method may include the steps of annealing and then quenching the alloy, before hardening the alloy.

The alloys are usually cast from melts under a shielding gas and then shaped. After shaping, they may be subjected to heat treatment, possibly under a shielding gas, to improve their mechanical properties.

In order to prepare the platinum alloy composition of the invention, a high temperature melting process is carried out. This can achieved using induction melting equipment, as is well known in the art. At all times, extreme care should be exercised in order to limit metal contamination, as platinum is easily contaminated by many elements routinely present in the environment. Such care can be achieved by melting the metals in either a vacuum or an inert gas atmosphere, by preventing contact with other metals, and by preventing mixing with silica-based products.

The platinum alloy is preferably melted and blended together by induction heating in appropriate crucibles for platinum alloys. After melting, the alloy can be poured through water to create grain-shot and can then be dried, weighed and used for casting.

For the preparation of the alloy of the present invention, the components of the inventive composition are preferably melted in a silica crucible (for small, fast melts) or a zirconium oxide (for large, slow melts) crucible in an induction oven. It is preferred to use a vacuum or inert gas in the melting process and to place all components of the alloy composition in the crucible at the same time. In the melting of the alloy, the molten metals should preferably be "turned" (utilizing medium to low frequency induction fields) in order to obtain an appropriate mixing of the metals.

Following the melting step, the resulting alloy nugget elements can be subjected to cold rolling and/or annealing in order to improve mechanical qualities of the mix. Thereafter, the mixed metal composition can optionally be re-melted as before, and a shot or plate be produced.

The preparation of the platinum alloys of the present invention can further comprise an annealing step. Annealing can be carried out either in a furnace or with a torch, as is well known in the art. The annealing temperature depends on the platinum content and the melting point of the alloy and will readily be determined by a person of ordinary skill by routine experiments. Preferably, the annealing is done in a furnace that is atmosphere controlled with shielding gas.

The shielding gas can be any of the non-oxidizing inert gasses, such as argon, nitrogen, or mixtures thereof; anti-oxidizing gasses such as hydrogen, carbon monoxide, or "forming" or "cracked ammonia" gas (nitrogen with a few percent of hydrogen). The piece can also be protected from oxidation by enveloping them with commercially available heat-treating wraps.

The alloys can be used for a wide variety of jewelry components, such as rings, clasps, spring parts, even compression-spring settings for gemstones, and the like.

Furthermore, the alloys can be repeatedly annealed and heat-treated/age-hardened, if desired.

As used herein, the term "age-hardening" is essentially synonymous with the term "precipitation hardening" which results from the formation of tiny particles of a new constituent (phase) within a solid solution. The presence of these particles create stress within the alloy and increase its yield strength and hardness. See, B. A. Rogers, "The Nature of Metals", p.320 (Iowa State University Press, 1964); H. W. Polock, "Materials Science and Metallurgy", p. 266 (Reston Pub. Inc. 1981) and "The Metals Handbook", pp.1-2 (Am. Soc'y Metals, 1986).

In their annealed/softened state the alloys can be worked by standard jewelry-making techniques: they can be rolled, drawn, soldered to, shaped, bent, stamped, etc. These alloys can be applied to a variety of designs for springs, gemstone mountings in rings, pendants, bracelets, chains, precious metal art objects, and the like.

It should be noted that in designing for structure of the jewelry or art object, the smallest cross-sectional area and shape of a component is taken into account. It is possible to adapt the design of the alloy to almost any configuration. The basic forms of these designs can vary, from simple sheet, to ring-shapes and more complex helixes, v-shapes, and the like. Objects can be wire, sheet, springs of all types, pendants, chain-links, brooches, and a multitude of others. Standard jewelry soldering techniques can be applied and repairs requiring heat can be carried out. The alloys can be shaped, bent, built onto, annealed, and when the piece is done, the spring power and hardness can be regained by heat-treatment.

The ornamental product can be made by casting. The hardness of the alloys may also be further increased by heat treatment. The heat treatment may be carried out in a range of from 300 to 950° C. with a suitable value being in the range of from 600 to 950° C., and typically of the order of 800° C. The alloys can be softened by standard annealing procedures, typically at about 850 to 950° C.

The alloys may be used in the form of wire, sheet or other manufactured article and may be given intricate shapes and forms due to their great hardness combined with great ductility.

The alloys according to the present invention can be used, for example, in the fabrication of wedding bands. Such weddings bands are generally produced by sawing blanks from tubes and then further working the blanks by suitable measures, such as milling, drawing, forging, and polishing.

Other jewelry articles that can be manufactured from the alloys according to the present invention include, for example, rings, necklaces, bracelets, earrings, bangles, stickpins, watch bands, watch bodies, wrist watches, tooth picks as well as other decorative articles such as ballpoint pens, letter openers, pocket knife handles, and the like.

The following Examples are provided to illustrate certain aspects of the invention and it is understood that such an Example does not limit the scope of the invention as defined in the appended claims.

EXAMPLE

An alloy of the composition as specified in the following table was weighted and molten under vacuum in a zirconia crucible in a vacuum induction furnace at a temperature of 1480 to 1500° C. to obtain a homogeneous melt. The alloy was cast into a water-cooled copper mold to form blocks having a dimension of 20×1430 mm. After a reduction of 75% irough a cold rolling process the alloy was annealed with 950° C. under a nitrogen atmosphere.

In the following table, the physical properties of the alloy specimens thus formed are specified. The melting range was determined by measuring the cooling curve of the alloy with a Degussa resistance furnace HR1/Pt/PtRH 10 equipped with a Linseis thermo element and a temperature-time-plotter L250. The Vickers hardness was determined according to EN ISO 14577 using a Wolpert V-Testor 4521 instrument. The tensile strength, elongation at break and yield stress were determined according to EN 10002 using a Zwick Z010 instrument. The color was determined visually.

COMPARISON EXAMPLE

A commercially available Pt/Cu 950/50 alloy was weighted and molten under vacuum in a zirconia crucible in a vacuum induction furnace to obtain a homogeneous melt. The alloy was cast into a water-cooled copper mold to form blocks having a dimension of 40×1140 mm. After a reduction to 20 mm trough a cold rolling process the alloy was annealed with 950° C. 50 minutes under a nitrogen atmosphere. The next deformation steps was 8 mm, 2.5 mm, 1.0 mm. Between the steps the material was annealead by 950° C.

The physical properties of the alloy specimens thus formed were tested as described above and are specified in the following table.

TABLE

| | EXAMPLE | COMPARISON EXAMPLE |
|---|---|---|
| Composition | Pt 58.6 wt. %<br>Cu 37.3 wt. %<br>Co 4.1 wt. % | Pt 95 wt. %<br>Cu 5 wt. % |
| Density | 13.6 | 20.3 |
| Color | platinum white | platinum white |
| Melting Range | 1360-1410 | 1730-1745 |
| Castability | excellent | fair |
| Hardness [HV] | | |
| softened state | 170 | 110 |
| 20% cold rolled | 260 | 185 |
| 40% cold rolled | 285 | 210 |
| 60% cold rolled | 300 | 235 |
| Tensile Strength [N/mm$^2$] | | |
| softened state | 650 | 320 |
| 60% cold rolled | ~1000 | ~800 |
| Yield Stress [N/mm$^2$] | 350 | 130 |
| Elongation at Break [%] | >30 | >30 |

The experimental results indicate that the alloy according to the present invention exhibits superior casting, wear and abrasion properties when compared to a conventional Pt/Cu 950/50 alloy. Furthermore, the experimental results indicate that the forming properties and the color tone of the alloy according to the present invention are comparable to those of a conventional Pt/Cu 950/50 alloy. The alloy according to the present invention was found to be an excellent material for the manufacture of jewelry articles such as rings, bracelets or necklaces. The working characteristics of the alloy of the invention are such that these articles of jewelry can be made using conventional, well known manufacturing techniques such as extruding, soldering, etc.

The principle of the invention and the best mode contemplated for applying that principle have been described. It is to be understood that the foregoing is illustrative only and that other means and techniques can be employed without departing from the true scope of the invention defined in the following claims.

What is claimed is:

1. A platinum alloy consisting essentially of:

55 to 63 wt. % of platinum, 2 to 10 wt. % of cobalt, and 27 to 43 wt. % of copper, wherein said alloy contains a total of 0.001 to 2 wt. % of one or more property enhancing additives selected from the group consisting of palladium, iridium and ruthenium.

2. The platinum alloy according to claim 1, wherein said alloy contains 57.5 to 59.9 wt. % of platinum.

3. The platinum alloy according to claim 1, wherein said alloy contains 58.5 to 59.0 wt. % of platinum.

4. The platinum alloy according to claim 1, wherein said alloy contains 2.0 to 8.0 wt. % of cobalt.

5. The platinum alloy according to claim 1, wherein said alloy contains 3.5 to 5.5 wt. % of cobalt.

6. The platinum alloy according to claim 1, wherein said alloy contains a total of 0.001 to 2 wt. % of one or more property enhancing additives selected from the group consisting of indium and gallium.

7. The platinum alloy according to claim 1, wherein the platinum alloy contains:

57.5 to 59.9 wt. % of platinum, 3.5 to 4.5 wt. % of cobalt, and 35.6 to 39 wt. % of copper, wherein 0.001 to 2 wt. % of copper may be substituted by one or more property enhancing additives selected from the group consisting of palladium, iridium and ruthenium, and wherein 0.001 to 2 wt. % of copper may be substituted by one or more property enhancing additives selected from the group consisting of indium and gallium.

8. The platinum alloy according to claim 1, wherein a tensile strength of said alloy is between about 450 to 800 $N/mm^2$.

9. The platinum alloy according to claim 1, wherein an elongation at break of said alloy is at least 20%.

10. The platinum alloy according to claim 1, wherein a color tone of said alloy corresponds essentially to a platinum white color tone of a PtCu950 alloy.

11. The platinum alloy according to claim 1, wherein a Vickers hardness of said alloy, measured at soft state, is between about 130 to 210 HV10.

12. An ornamental article comprising a platinum alloy, said platinum alloy consisting essentially of:

55 to 63 wt. % of platinum, 2 to 10 wt. % of cobalt and 27 to 43 wt. % of copper, wherein said ornamental article is selected from the group consisting of a ring, a necklace, an earring, a watch band, and a watch body.

13. The ornamental article according to claim 12, wherein said alloy contains 57.5 to 59.9 wt. % of platinum.

14. The ornamental article according to claim 12, wherein said alloy contains 58.5 to 59.0 wt. % of platinum.

15. Presented) The ornamental article according to claim 12, wherein said alloy contains 2.0 to 8.0 wt. % of cobalt.

16. The ornamental article according to claim 12, wherein said alloy contains 3.5 to 5.5 wt. % of cobalt.

17. An ornamental article comprising a platinum alloy, said platinum alloy consisting essentially of:

55 to 63 wt. % of platinum, 2 to 10 wt. % of cobalt and 27 to 43 wt. % of copper, wherein said alloy contains a total of 0.001 to 2 wt. % of one or more property enhancing additives selected from the group consisting of palladium, iridium and ruthenium.

18. The ornamental article according to claim 12, wherein said alloy contains a total of 0.001 to 2 wt. % of one or more property enhancing additives selected from the group consisting of indium and gallium.

19. The ornamental article according to claim 12, wherein the platinum alloy contains:

57.5 to 59.9 wt. % of platinum, 3.5 to 4.5 wt. % of cobalt, and 35.6 to 39 wt. % of copper, wherein 0.001 to 2 wt. % of copper may be substituted by one or more property enhancing additives selected from the group consisting of palladium, iridium and ruthenium, and wherein 0.001 to 2 wt. % of copper may be substituted by one or more property enhancing additives selected from the group consisting of indium and gallium.

20. The ornamental article according to claim 12, wherein a tensile strength of said alloy is between about 450 to 800 $N/mm^2$.

21. The ornamental article according to claim 12, wherein an elongation at break of said alloy is at least 20%.

22. The ornamental article according to claim 12, wherein a color tone of said alloy corresponds essentially to a platinum white color tone of a PtCu950 alloy.

23. The ornamental article according to claim 12, wherein a Vickers hardness of said alloy, measured at soft state, is between about 130 to 210 HV10.

24. A method of preparing a platinum alloy, comprising the steps of:

providing alloy components, said alloy components consisting essentially of: 55 to 63 wt. % of platinum, 2 to 10 wt. % of cobalt, and 27 to 43 wt. % of copper;

blending the alloy components together; and melting the alloy components to form said alloy, wherein said alloy contains a total of 0.001 to 2 wt. % of one or more property enhancing additives selected from the group consisting of palladium, iridium and ruthenium.

25. The method according to claim 24, wherein said alloy contains 57.5 to 59.9 wt. % of platinum.

26. The method according to claim 24, wherein said alloy contains 58.5 to 59.0 wt. % of platinum.

27. The method according to claim 24, wherein said alloy contains 2.0 to 8.0 wt. % of cobalt.

28. The method according to claim 24, wherein said alloy contains 3.5 to 5.5 wt. % of cobalt.

29. The method according to claim 24, wherein said alloy contains a total of 0.001 to 2 wt. % of one or more property enhancing additives selected from the group consisting of indium and gallium.

30. The method according to claim 24, wherein the platinum alloy contains:

57.5 to 59.9 wt. % of platinum, 3.5 to 4.5 wt. % of cobalt, and 35.6 to 39 wt. % of copper, wherein 0.001 to 2 wt. % of copper may be substituted by one or more property enhancing additives selected from the group consisting of palladium, iridium and ruthenium, and wherein 0.001 to 2 wt. % of copper may be substituted by one or more property enhancing additives selected from the group consisting of indium and gallium.

31. The method according to claim 24, wherein a tensile strength of said alloy is between about 450 to 800 $N/mm^2$.

32. The method according to claim 24, wherein an elongation at break of said alloy is at least 20%.

33. The method according to claim 24, wherein a color tone of said alloy corresponds essentially to a platinum white color tone of a PtCu950 alloy.

34. The method according to claim 24, wherein a Vickers hardness of said alloy, measured at soft state, is between about 130 to 210 HV10.

* * * * *